US009873606B2

(12) United States Patent
Nachawati et al.

(10) Patent No.: US 9,873,606 B2
(45) Date of Patent: Jan. 23, 2018

(54) SELF-PRESSURIZED CONCENTRATE SOURCE FOR POST-MIX EQUIPMENT

(71) Applicant: PepsiCo, Inc., Purchase, NY (US)

(72) Inventors: Maher Nachawati, Stamford, CT (US); Maximiliano Rodriguez, Bridgewater, NJ (US)

(73) Assignee: PEPSICO, INC., Purchase, NY (US)

( * ) Notice: Subject to any disclaimer, the term of this patent is extended or adjusted under 35 U.S.C. 154(b) by 90 days.

(21) Appl. No.: 14/990,543

(22) Filed: Jan. 7, 2016

(65) Prior Publication Data

US 2017/0197817 A1 Jul. 13, 2017

(51) Int. Cl.

| | |
|---|---|
| ***B67D 1/04*** | (2006.01) |
| ***B67D 1/00*** | (2006.01) |
| ***B67D 1/08*** | (2006.01) |
| ***B67D 1/12*** | (2006.01) |

(52) U.S. Cl.

CPC ..... *B67D 1/0462* (2013.01); *B67D 1/0028* (2013.01); *B67D 1/0894* (2013.01); *B67D 1/1279* (2013.01)

(58) Field of Classification Search

CPC .. B67D 1/0462; B67D 1/1279; B67D 1/0894; B67D 1/0028

USPC ..... 222/145.5, 105, 95, 402.14, 402.25, 1

See application file for complete search history.

(56) References Cited

U.S. PATENT DOCUMENTS

| | | | | |
|---|---|---|---|---|
| 4,846,234 | A | 7/1989 | Rudick | |
| 4,901,886 | A | 2/1990 | Kirschner | |
| 5,000,351 | A * | 3/1991 | Rudick | B67D 1/0036 222/105 |
| 5,011,700 | A | 4/1991 | Gustafson et al. | |
| 5,082,143 | A | 1/1992 | Schramm, Jr. | |
| 5,727,713 | A | 3/1998 | Kateman et al. | |
| 7,972,639 | B2 | 7/2011 | Guerrero et al. | |
| 2008/0086753 | A1 | 4/2008 | Newton | |
| 2009/0108021 | A1 | 4/2009 | Hansen et al. | |
| 2009/0236361 | A1 | 9/2009 | Doelman et al. | |
| 2010/0116842 | A1 | 5/2010 | Hecht et al. | |
| 2014/0117043 | A1 * | 5/2014 | Ware | B65D 85/84 222/95 |
| 2015/0034674 | A1 | 2/2015 | Hertensen | |

FOREIGN PATENT DOCUMENTS

| | | |
|---|---|---|
| WO | WO 2012/149613 A2 | 11/2012 |
| WO | WO 2015/094774 A1 | 6/2015 |

OTHER PUBLICATIONS

International Search Report in corresponding PCT Application No. PCT/US2017/012159, dated Mar. 24, 2017, 2 pages.

* cited by examiner

*Primary Examiner* — Donnell Long

(74) *Attorney, Agent, or Firm* — Sterne, Kessler, Goldstein & Fox P.L.L.C.

(57) ABSTRACT

A post-mix beverage dispenser utilizing a liquid concentrate in a self-pressurized container is provided. The beverage dispenser includes a connector and flow control valve to regulate the pressure of the liquid concentrate in the system. The liquid concentrate and diluent are mixed at the nozzle of the post-mix beverage dispense.

18 Claims, 10 Drawing Sheets

SELF-PRESSURIZED CONCENTRATE SOURCE FOR POST-MIX EQUIPMENT

BACKGROUND

Field

Embodiments of the present invention relate to post-mix dispensers to dispense beverage liquid concentrates from a self-pressurized container, e.g., a bag-on-valve container, as a component source.

Background

Post-mix dispensers are typically limited to dispensing syrup or liquid concentrates from a bag-in-box package. The syrup or concentrate is introduced into the system through the use of a pump or a pressurized tank, e.g., $CO_2$. Thus, a typical post-mix system requires a great deal of components and technical understanding to set up and maintain the system.

BRIEF SUMMARY OF THE INVENTION

One aspect of the invention permits a post-mix dispensing system that can deliver beverage liquid concentrates from a self-pressurized container. A further aspect of the invention includes connecting a self-pressurized container to post-mix equipment for the purpose of dispensing beverage flavor concentrates including, but not limited to, flavor shots, carbonated soft drinks, tea concentrate, coffee, lemonade, and other types of beverages. The dispensed beverage can be hot or cold.

In one aspect of the invention, the post-mix beverage dispensing system includes a nozzle, a diluent conduit in fluid communication with the nozzle, a concentrate conduit in fluid communication with the nozzle, a flow control valve in, fluid communication with the concentrate conduit and a source conduit, and a self-pressurized concentrate source. The self-pressurized concentrate source can be connected to the source conduit by a connector and can include a concentrate chamber containing a beverage concentrate, a pressurized outer container surrounding the concentrate chamber and exerting a pressure on the concentrate chamber, and a valve assembly in fluid communication with an interior of the concentrate chamber, such that the connector opens the valve assembly. In one aspect of the invention, the concentrate chamber is a bag. Other embodiments of self-pressurized systems commonly known to those skilled in the art, such as piston cup containers, can also be used. The beverage concentrate and a diluent can mix at the nozzle to dispense a beverage.

In a further aspect of the invention, a method for dispensing a beverage from a post-mix beverage dispensing system can include connecting a self-pressurized concentrate source to a connector, the connector being in fluid communication with a dispensing nozzle. The pressurized concentrate source can include a concentrate chamber containing a beverage concentrate, a pressurized outer container surrounding the concentrate chamber and exerting a pressure on the concentrate chamber, and a valve assembly in fluid communication with an interior of the concentrate chamber, such that the connector opens the valve assembly to provide the beverage concentrate to the source conduit. The method further includes mixing the beverage concentrate and a diluent at the dispensing nozzle to dispense a beverage.

In another aspect of the invention, a method of retrofitting a post-mix beverage dispensing system with a self-pressurized concentrate source can include connecting a connector to a source conduit, the source conduit being in fluid communication with a dispensing nozzle, and connecting a self-pressurized concentrate source to the connector. The pressurized concentrate source can include a concentrate chamber containing a beverage concentrate, a pressurized outer container surrounding the concentrate chamber and exerting a pressure on the concentrate chamber, and a valve assembly in fluid communication with an interior of the concentrate chamber, such that the connector opens the valve assembly to provide the beverage concentrate to the source conduit. The retrofit post-mix beverage dispensing system can mix the beverage concentrate and a diluent at the dispensing nozzle to dispense a bevel age.

Further features and advantages of embodiments of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to a person skilled in the relevant arts(s) based on the teachings contained herein.

BRIEF DESCRIPTION OF THE DRAWINGS/FIGURE

The accompanying drawings, which are incorporated herein and form part of the specification, illustrate embodiments of the present invention and, together with the description, further serve to explain the principles of the invention and to enable a person skilled in the relevant art(s) to make and use the invention.

Figure 5:
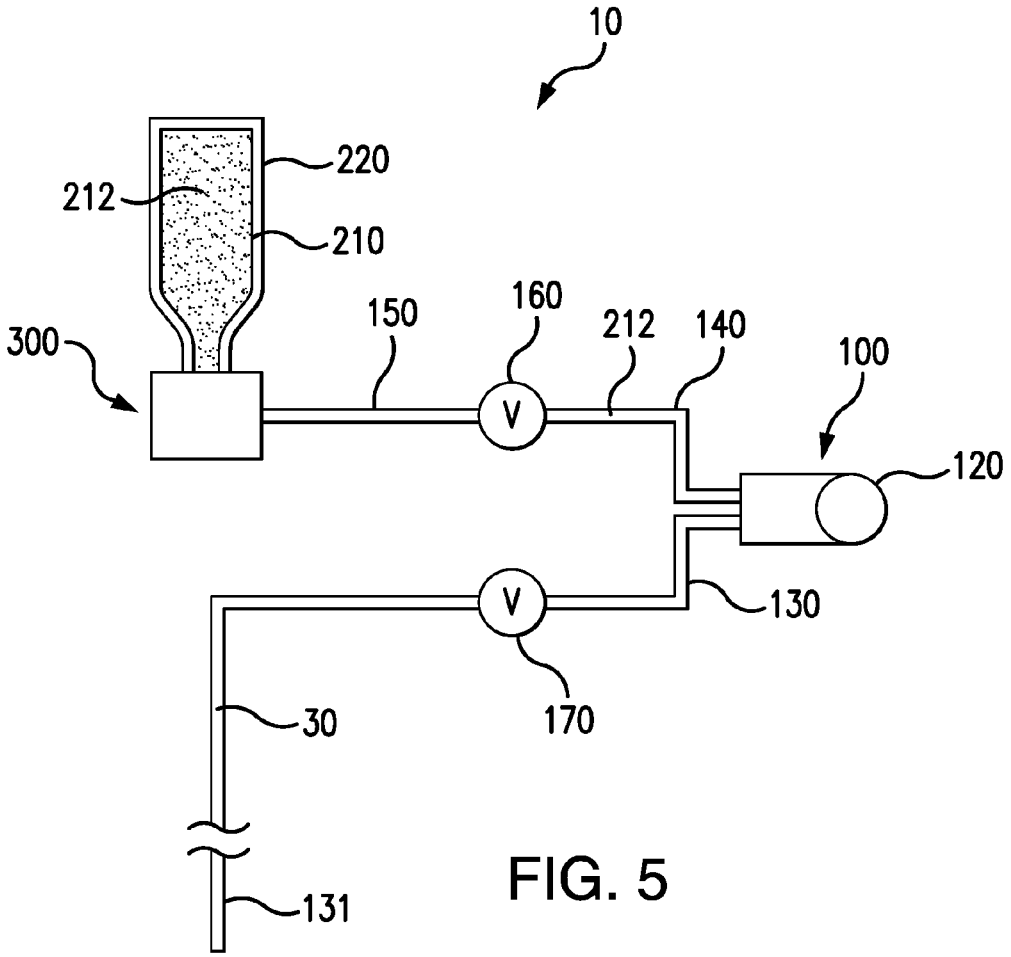

FIG. 5. is a schematic view of a beverage dispensing system according to various aspects of the invention.

Figure 6:
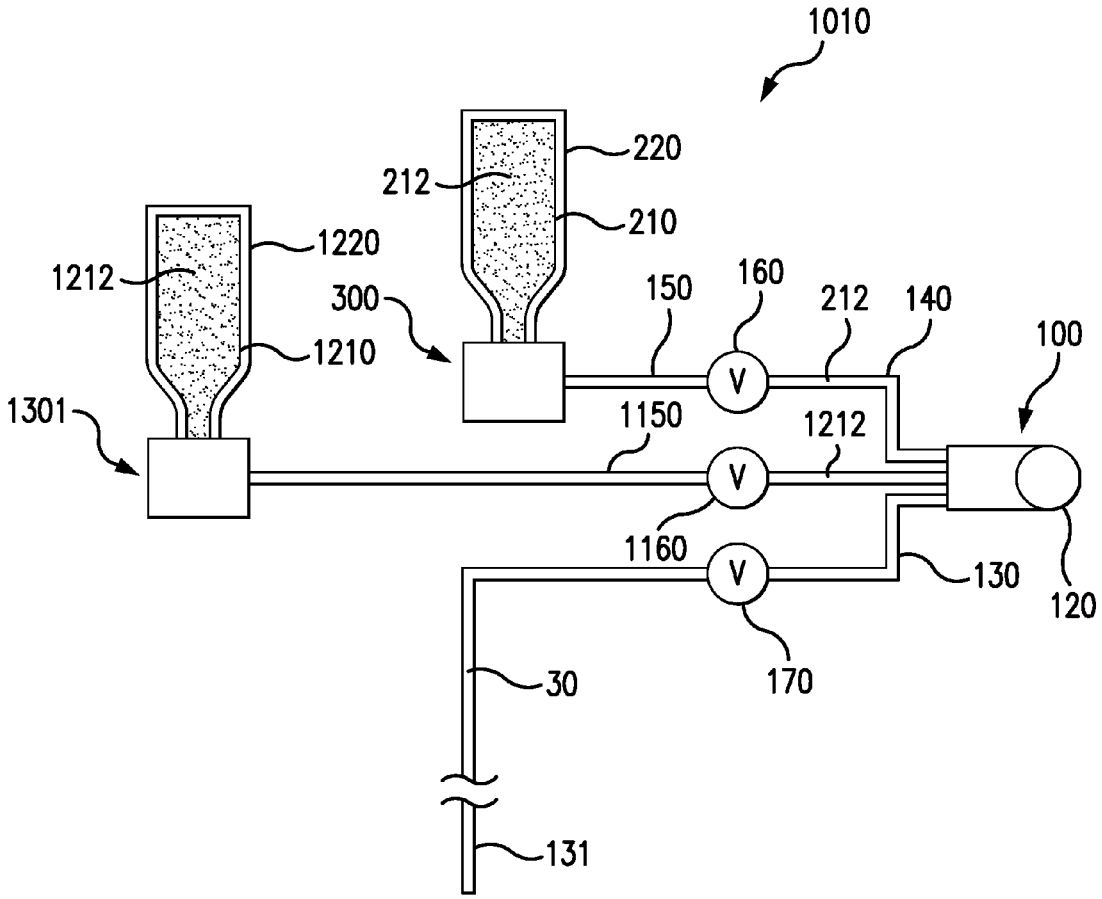

FIG. 6. is a schematic view of a beverage dispensing system according to various aspects of the invention.

Figure 7:
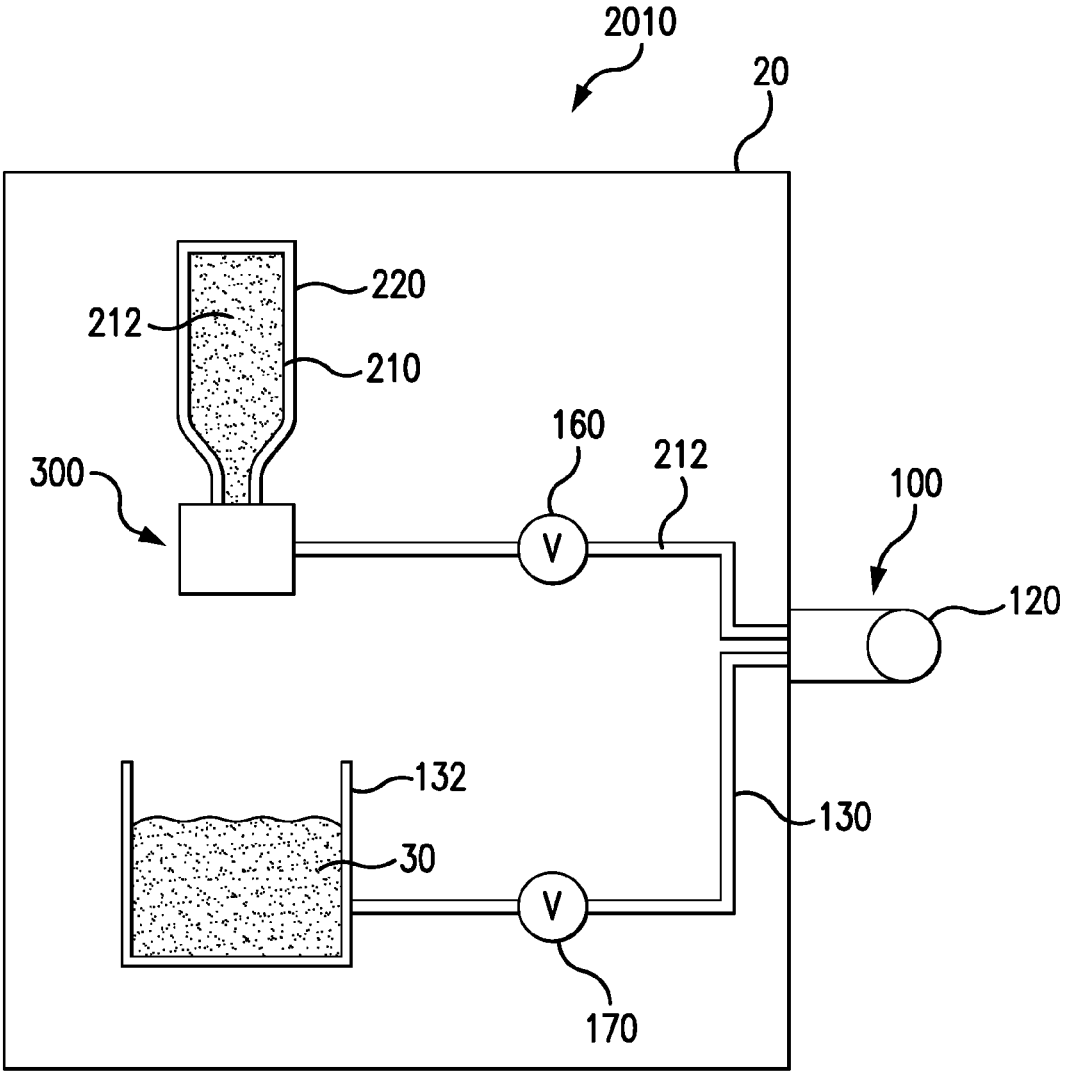

FIG. 7. is a schematic view of a beverage dispensing system according to various aspects of the invention.

Figure 8:
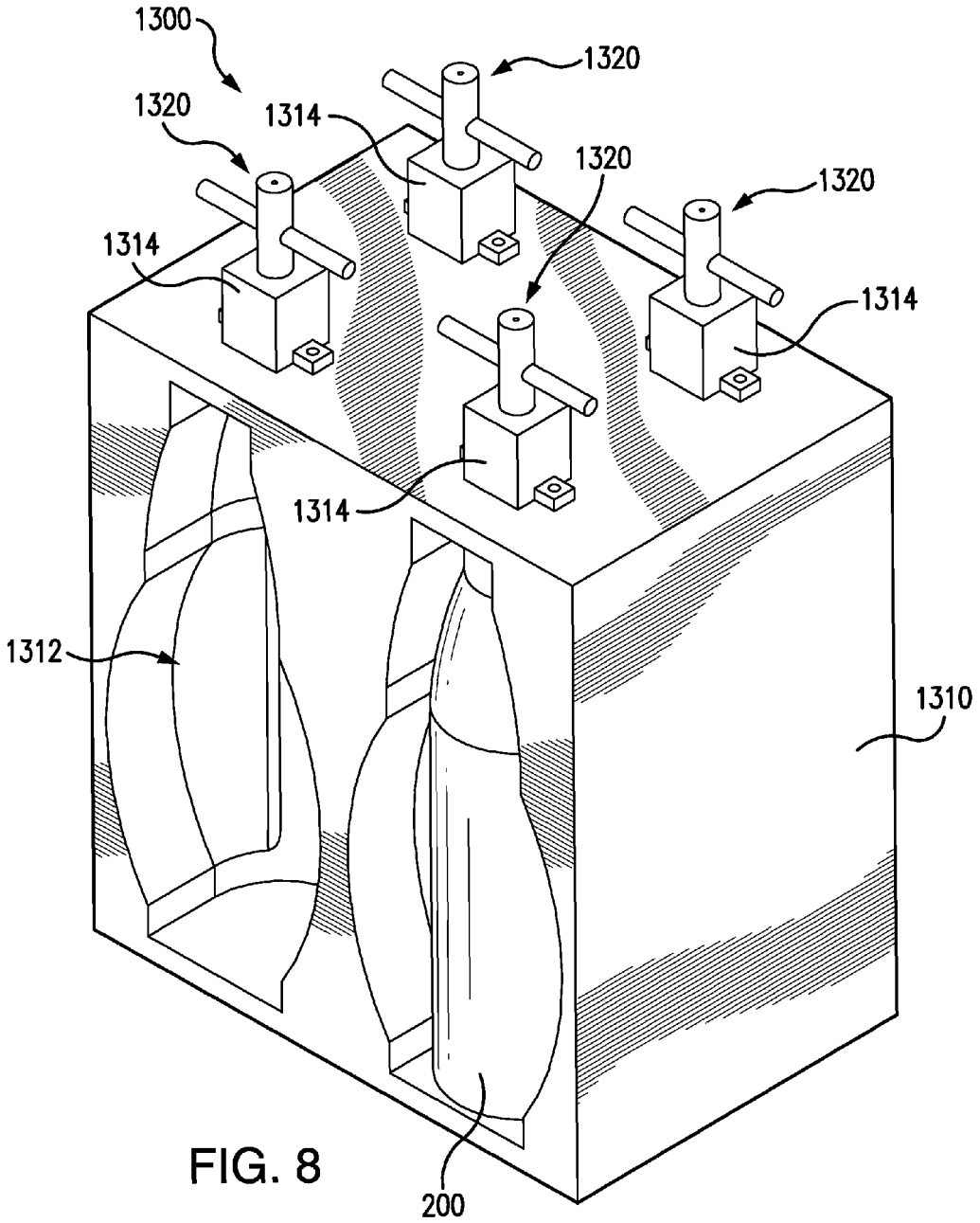

FIG. 8 is a perspective view of a connector for self-pressurized containers according to various aspects of the invention.

Figure 9:
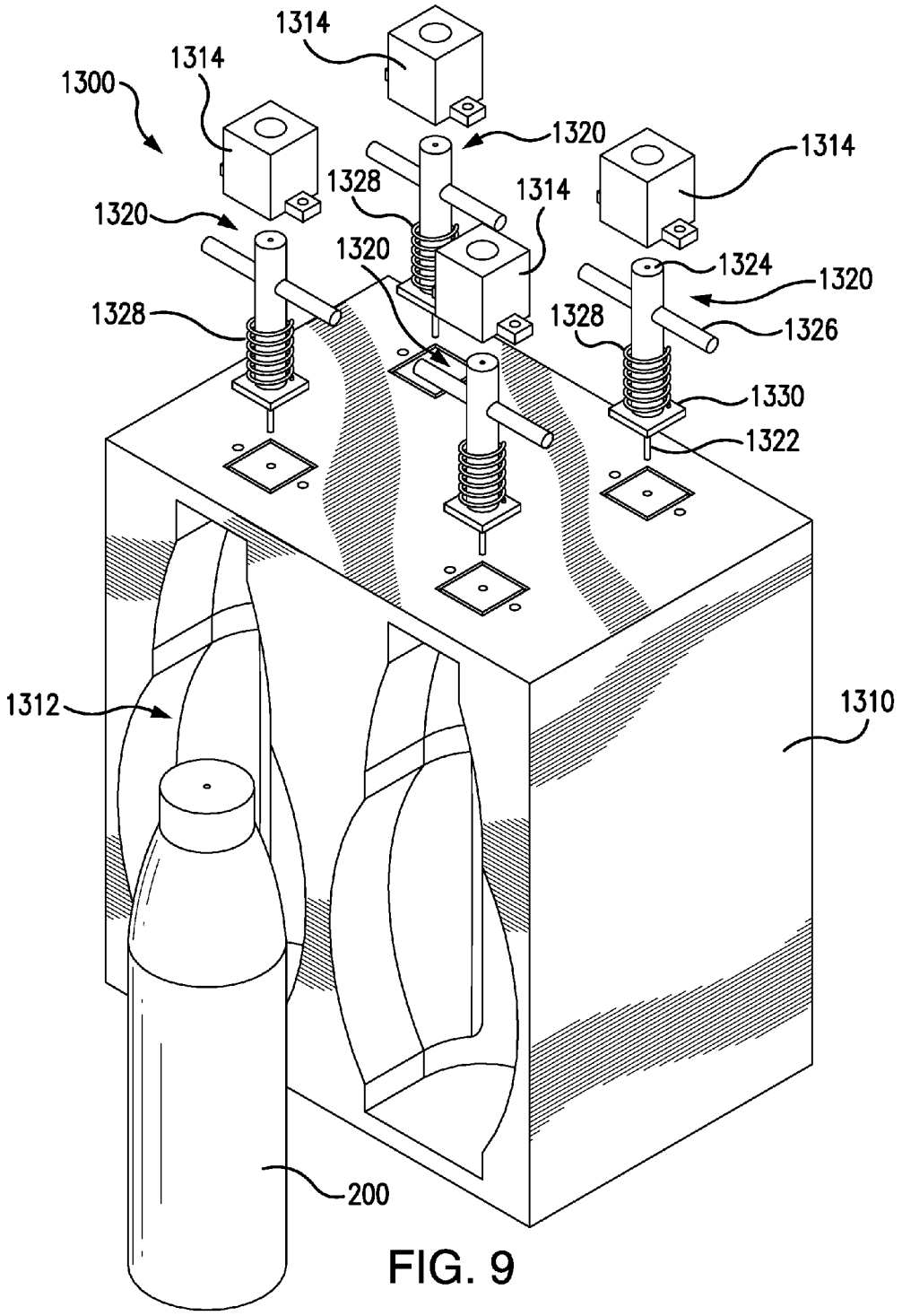

FIG. 9 is an exploded perspective view of a connector for self-pressurized containers according to various aspects of the invention.

Figure 10:
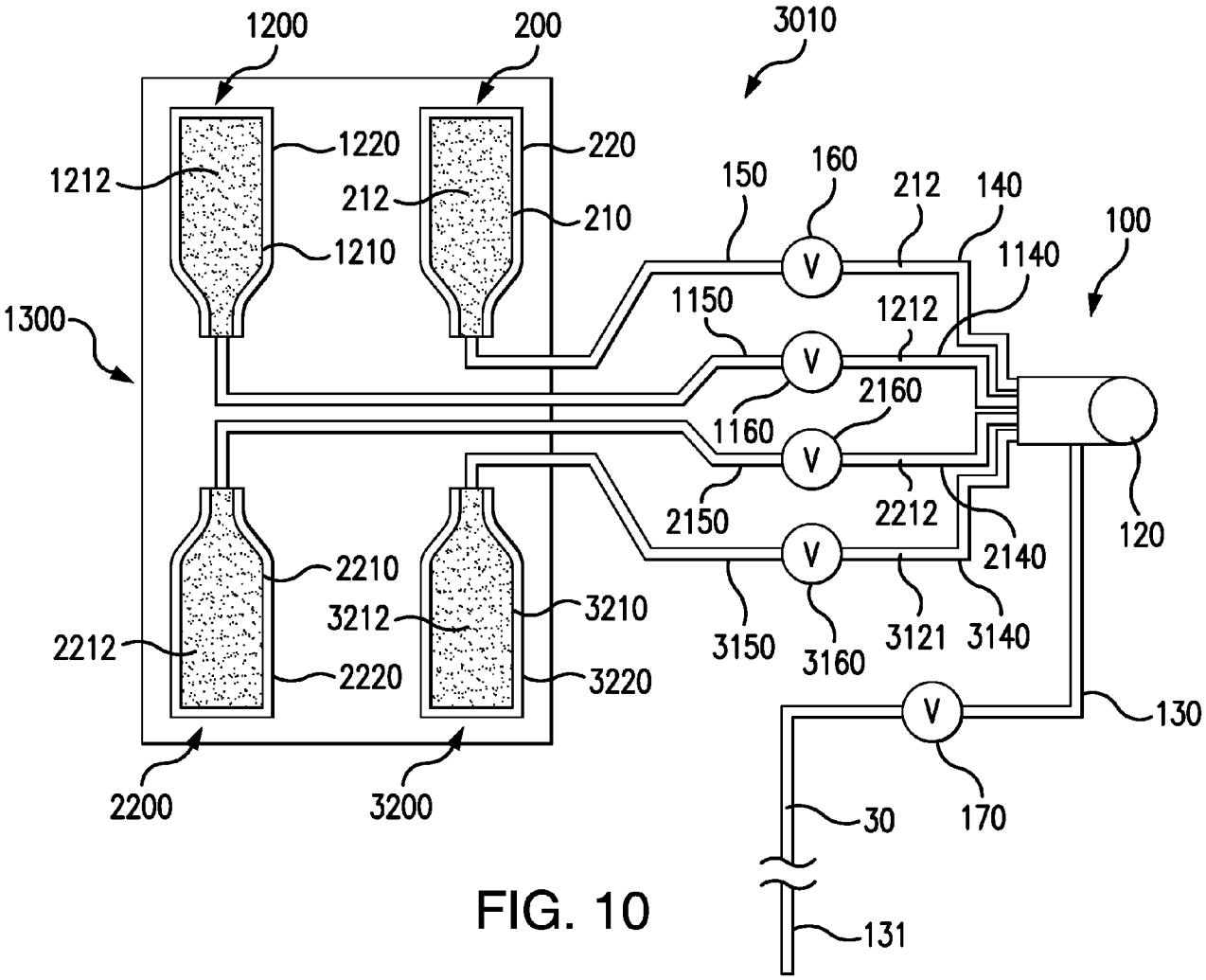

FIG. 10 is a schematic view of a beverage dispensing system according to various aspects of the invention.

Features and advantages of the embodiments will become more apparent from the detailed description set forth below when taken in conjunction with the drawings, in which like reference characters identify corresponding elements throughout.

DETAILED DESCRIPTION OF THE INVENTION

The present invention(s) will now be described in detail with reference to embodiments thereof as illustrated in the accompanying drawings. References to "one embodiment", "an embodiment", "an exemplary embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

In one aspect of the invention, a beverage liquid concentrate self-pressurized bag-on-valve container can be connected into a post mix system, the internal pressure from the bag-on-valve system permits the liquid concentrate to be introduced into the post-mix system for dispensing at the nozzle. Upon connection to the system, the bag-on-valve output valve is opened, thus allowing liquid concentrate to flow into the system. Such a configuration simplifies the post-mix system and enables one without technical knowledge or expertise to provide beverages from liquid concentrate. Use of a beverage liquid concentrate, in a self-pressurized bag-on-valve container also eliminates the need for a delivery pump or pressurized cylinder to propel the liquid concentrate.

The beverage liquid concentrate in a self-pressurized bag-on-valve container also provides for the ability to extend the yield and shelf life on beverage products as the liquid concentrate is isolated from the gas and pressurization contained within the bag-on-valve container. Current bag-in-box systems expose the beverage liquid concentrates to the atmosphere which causes more rapid oxidation of the syrup within.

The system also provides for beverage dispensing without the need for an electric, hydraulic, or pneumatic power source to draw the liquid concentrate from its container into the beverage dispensing system.

An aspect of the present invention will now be described with reference to FIGS. 1-5. Throughout the system, conventional beverage tubing (FDA approved for use with food products) is used to connect the components of the system. Any of the beverage tubing conduits may be insulated to prevent heat loss or gain. In the beverage dispensing system 10 shown in FIGS. 1 and 5, a pressurized diluent source 131 supplies diluent 30, e.g., water, to the system 100. In one aspect, the diluent 30 can be at typical domestic water pressures, e.g., approximately 50-300 pounds per square inch (psi). Diluent source 131 provides diluent 30 to a flow control valve 170 which is fluidly connected to diluent conduit 130. Diluent conduit 130 delivers the diluent to nozzle 120 so that diluent 30 can be dispensed into a user's container, cup, or pitcher. Beverage dispensing system 10 can include a housing 20 and a nozzle assembly 100. Nozzle assembly 100 includes lever 110 and nozzle 120. Beverage liquid concentrate 212 is supplied to beverage dispensing system 10 and mixes with diluent 30 at nozzle 120. The use of a post-mix system that directly mixes the concentrate and diluent at the nozzle avoids cross contamination of multiple concentrate sources and can reduce the unwanted growth of bacteria within the beverage system.

Figure 1:
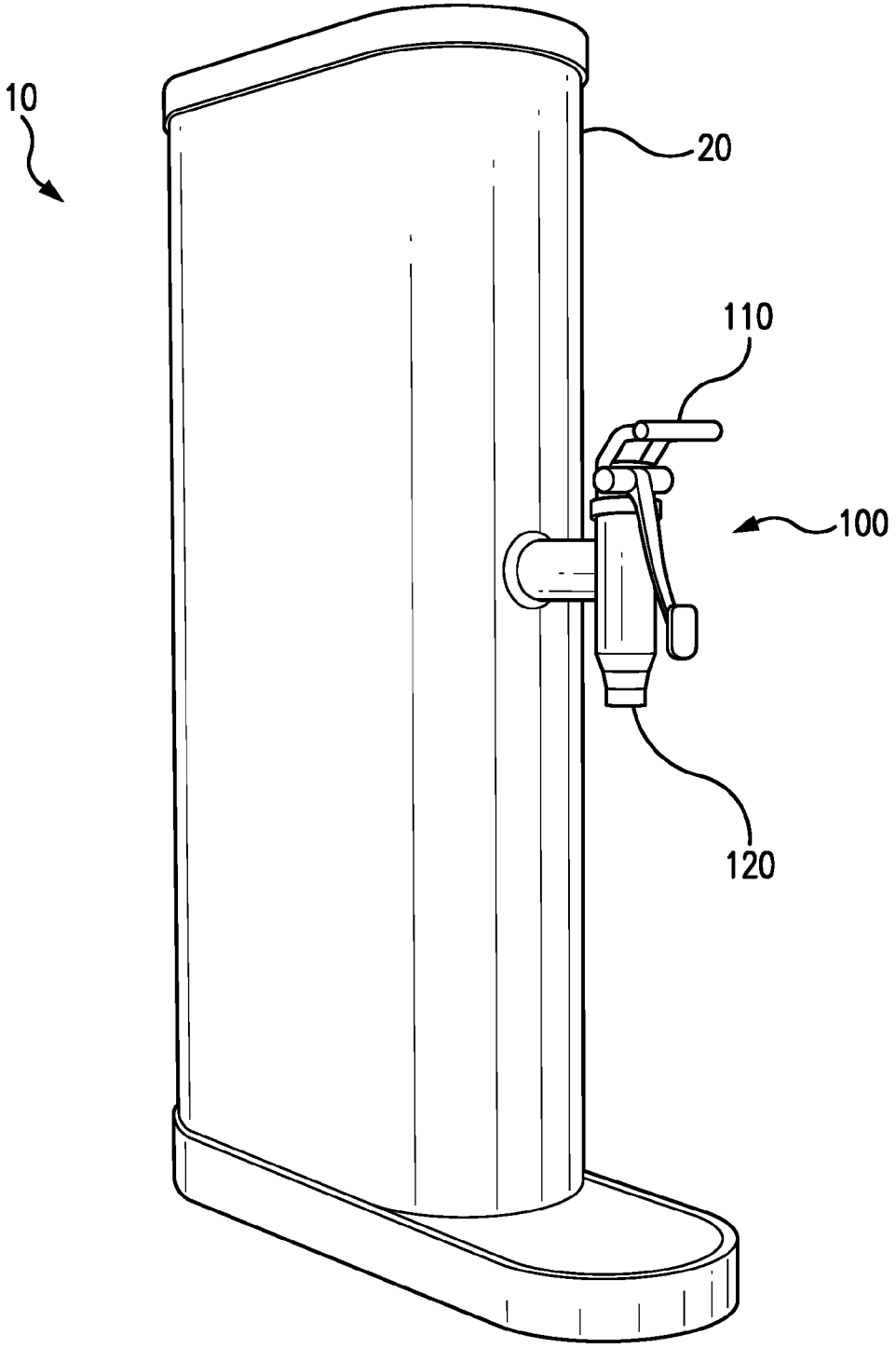
FIG. 1 is a perspective view of a beverage dispensing system according to various aspects of the invention.
Figure 2:
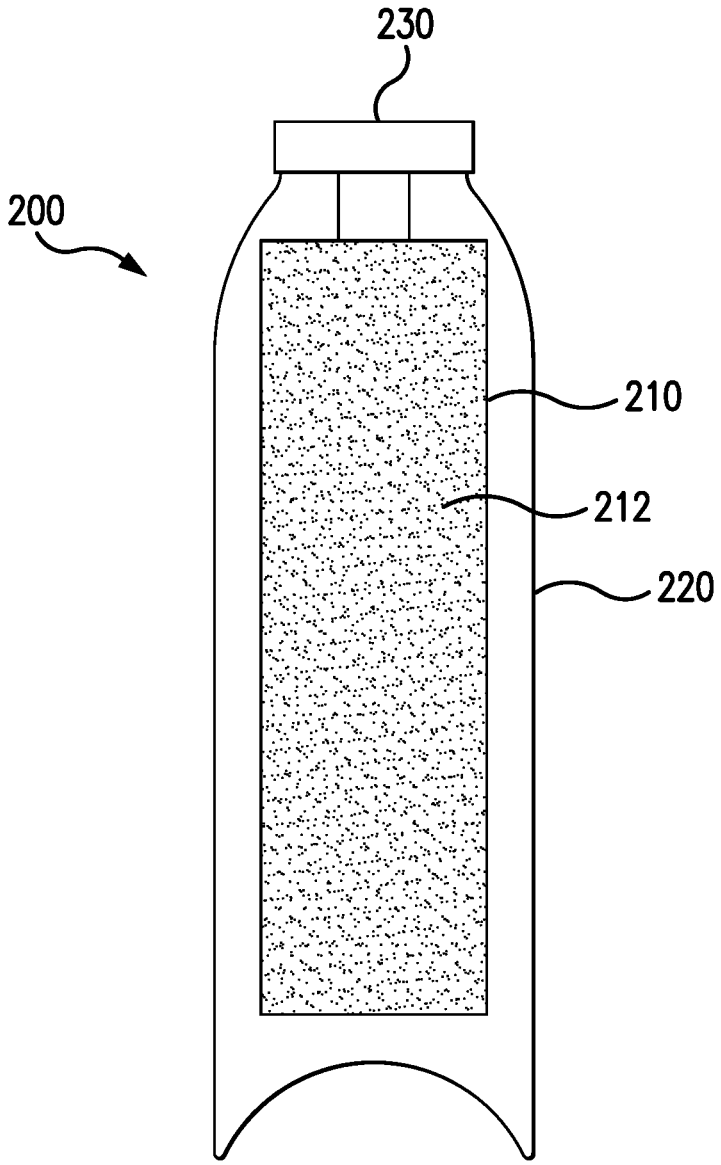
FIG. 2 is a front view of a beverage liquid concentrate within a self-pressurized container according to various aspects of the invention.

Beverage dispensing system 10 can utilize a conventional bag-on-valve container to supply self-pressurized beverage liquid concentrate. As shown in FIG. 2, self-pressurized concentrate source 200 includes a beverage liquid concentrate 212 contained in a concentrate chamber 210. Beverage liquid concentrate 212 and concentrate chamber 210 are surrounded by outer container 220. In one aspect of the invention, concentrate chamber 210 and outer container 220 can be transparent to allow a user to view the amount of beverage liquid concentrate 212 remaining within concentrate chamber 210.

Self-pressurized concentrate source 200 also includes valve assembly 230 located at the top portion of outer container 220. Valve assembly 230 retains beverage liquid concentrate 212 within self-pressurized concentrate source 200. The valve within valve assembly 230 permits beverage liquid concentrate 212 to be dispensed upon connection into beverage dispensing system 10. In one aspect of the invention, valve assembly 230 includes a push valve.

In a typical filling process, concentrate chamber 210, attached to valve assembly 230, is inserted into outer container 220. Next, outer container 220 is pressurized and valve assembly 230 is crimped onto outer container 220, thus retaining the pressure within outer container 220. In one aspect of the invention, outer container 220 can be an approximately 14.5 fluid ounce container that is pressurized to approximately 45 psi. Concentrate chamber 210 can then be pressure filled with beverage liquid concentrate 210. In one aspect, after pressure filling concentrate chamber 210, internal pressure within outer container 220 can be approximately 120 psi. After a weight and pressure check, self-pressurized concentrate source 200 is ready for transport and/or use in beverage dispensing system 10.

Figure 3:
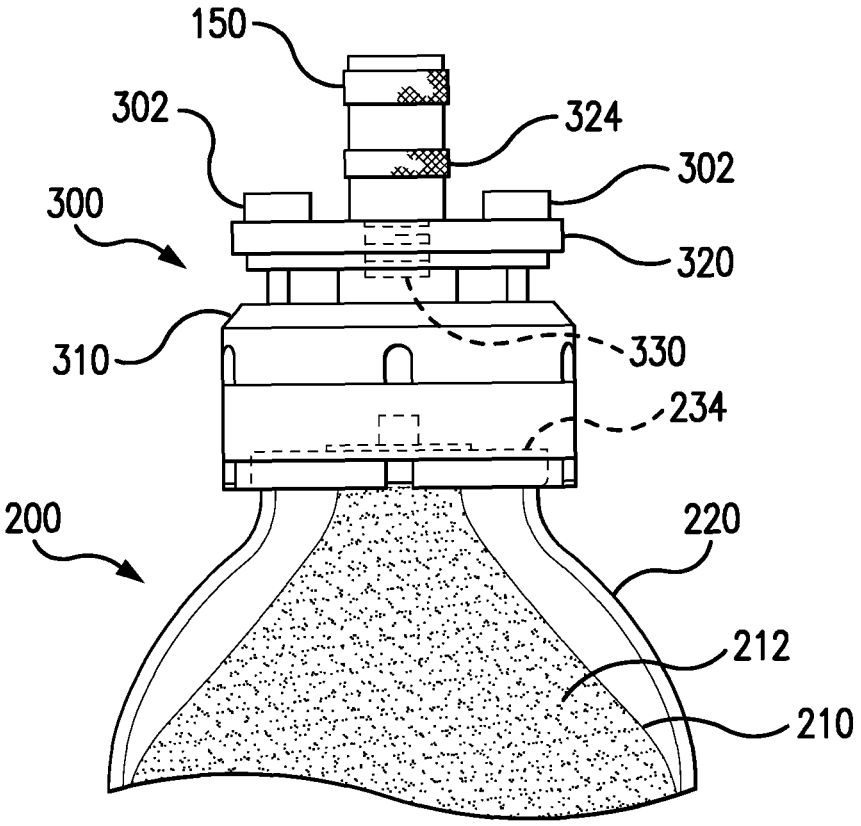
FIG. 3 is a partial front view of a connector for a self-pressurized container according to various aspects of the invention.
Figure 4:
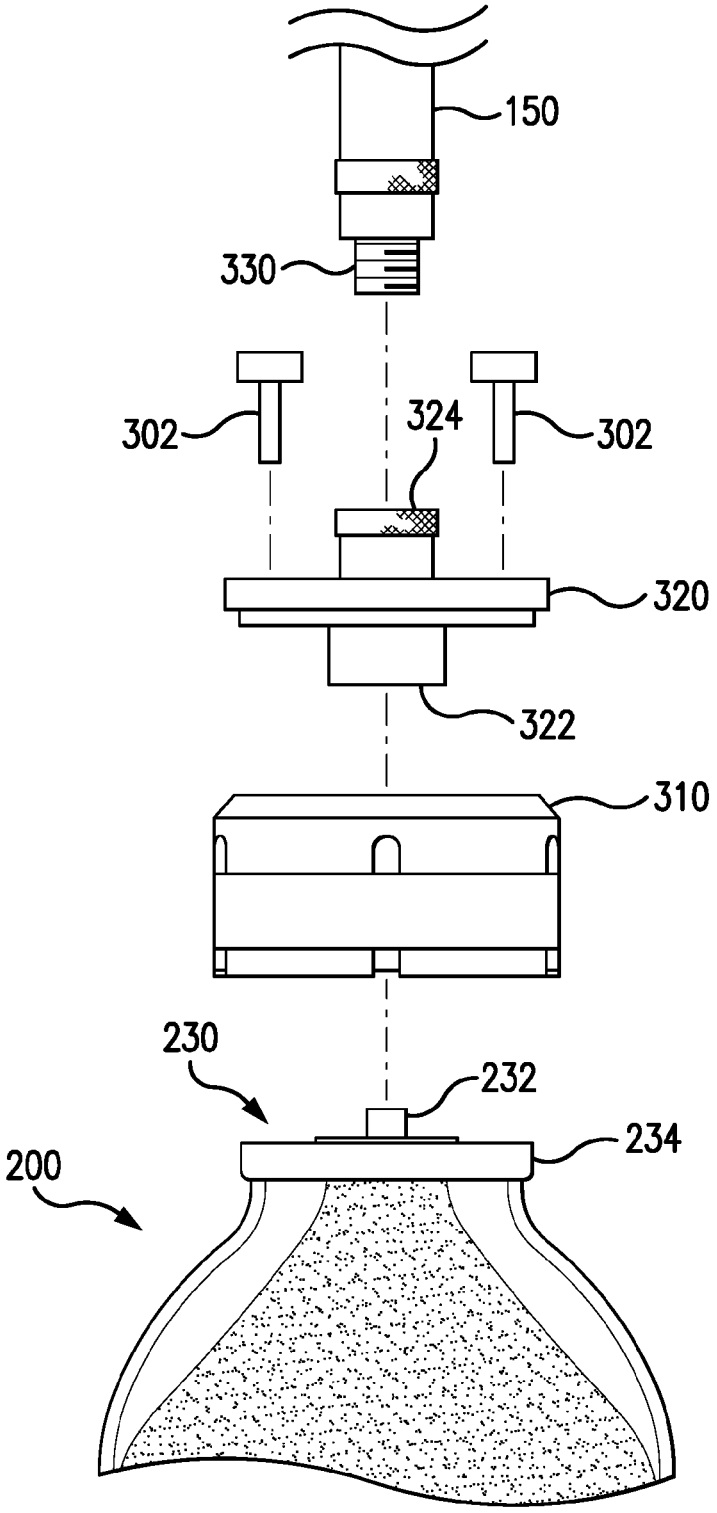
FIG. 4 is an exploded front view of a connector for a self-pressurized container according to various aspects of the invention.

Referring now to FIGS. 3-4, connector 300 interacts with self-pressurized concentrate source 200 to deliver beverage liquid concentrate 210 into beverage dispensing system 10. In one aspect of the invention, connector 300 can include a sealing collar 310 that engages valve cup 234 of valve assembly 230 that surrounds the top portion of outer container 220. Sealing collar 310 can be fastened to valve cup 234 with a friction fit by pressing sealing collar 310 onto valve cup 234. In an alternate aspect of the invention, sealing collar 310 can be clamped onto valve cup 234. Sealing collar 310 can also include internal threading to receive valve cup 234. In this aspect, self-pressurized concentrate source 200 can be screwed into sealing collar 310. Alternatively, sealing, collar 310 can be bolted to or otherwise detachably attached to valve cup 234.

Connector 300 can also include a valve activation device 320 that engages the valve stem 232 within valve assembly 230 to release beverage liquid concentrate 212 from within concentrate chamber 210. Valve activation device 320 can include a through bore through which beverage liquid concentrate 212 can flow. In one aspect of the invention, attachment of connector 300 to self-pressurized concentrate source 200 pushes a proximal portion 322 of valve activation device 320 into valve stem 232, thus releasing beverage liquid concentrate 212 from within concentrate chamber 210. Valve activation device 320 can be attached to sealing collar 310 with fasteners 302. In this aspect, connector 300 can include a gasket between valve activation device 320 and sealing collar 310. In an alternate aspect, sealing collar 310 and valve activation device 320 can, be formed as a unitary piece.

Connector 300 can be connected to beverage dispensing system 10 through transfer shaft 330. IL one aspect of the invention, transfer shaft 330 connects to the through bore in valve activation device 320. Transfer shaft 330 can be fastened to valve activation device 320 with a friction fit by pressing transfer shaft 330 onto valve activation device 320. In an alternate aspect of the invention, transfer shaft 330 can be clamped onto valve activation device 320 or can include threading to screw into valve activation device 320. Transfer shaft 330 connects to source conduit 150 which directs the beverage liquid concentrate 212 into beverage dispensing system 10. In another aspect of the invention, valve activation device 320 can include a barbed fitting area where a tube can be fitted over the barb and crimped to prevent leaks.

In another aspect of the invention, a beverage dispensing system can be retrofit to include connector 300 for use with self-pressurized concentrate source 200. In this aspect, the beverage dispensing, system to be retrofit typically includes a non-pressurized concentrate source, e.g., a bag-in-box system, and a non-pressurized concentrate source dispenser, e.g., an electrical or pneumatic pump or pressurized cylinder, to draw the concentrate from within the non-pressurized concentrate source into the beverage dispensing system. The non-pressurized concentrate source and the non-pressurized concentrate source dispenser can be disconnected from the beverage dispensing system. The conduit that previously connected the non-pressurized concentrate source can then be attached to connector 300. Connector 300 can in turn be attached to self-pressurized concentrate source 200 to dispense beverage liquid concentrate 212 into the retrofit beverage dispensing system.

Referring now to FIG. 5, upon attachment to connector 300, beverage liquid concentrate 212 from within self-pressurized concentrate source 200 flows through connector 300 to source conduit 150. Source conduit 150 is fluidly connected to concentrate flow conduit valve 160 which is fluidly connected to concentrate conduit 140. Concentrate conduit 140 is fluidly connected, to nozzle 120 which dispenses beverage liquid concentrate 212 into a container or cup.

Concentrate flow control valve 160 controls the rate at which beverage liquid concentrate 212 enters concentrate conduit 140 and ultimately nozzle 120. In one aspect of the invention, concentrate flow control valve 160 can restrict the flow of beverage liquid concentrate 212 to approximately 0.1 ounces per second, thus creating, a 46:1 capability. The flow rate of beverage liquid concentrate 212 can be modified at concentrate flow control valve 160 based on the concentration ratio of beverage liquid concentrate 212.

The beverage liquid concentrate 212 can be any concentration ratio. In one aspect of the invention, the beverage liquid concentrate 212 can be up to approximately a 100:1 dilution ratio based on volume, allowing storage of a highly concentrated beverage within a relatively small space. In an alternate aspect of the invention, the beverage liquid concentrate 212 can be up to approximately a 30:1 dilution ratio based on volume. In a further aspect of the invention, the beverage liquid concentrate 212 can be up to approximately an 80:1 dilution ratio based on volume.

Concentrate flow control valve 160 and diluent flow control valve, 170 can be a mechanical valve, e.g., a conventional plunger valve that is movable between fully-opened and fully-closed positions. In addition, each of valves 160 and 170 can contain an orifice restriction of a predetermined size to meter the flow of liquid therethrough. That is, based on the relative sizes of the orifice restrictions of the valves, the correct proportion of the diluent 30 or beverage liquid concentrate 212 can be maintained regardless of the incoming pressure. In an alternate aspect of the invention, valves 160 and 170 can be electronic solenoid-operated valves. In this aspect, operation of valves 160 and 170 can be controlled by an electronic control module that includes a programmable microprocessor. The programmable microprocessor (not shown) can provide intelligent control of the beverage system. The microprocessor can control the dispensing function (e.g., valve operation, etc.), monitor system status such as the diluent temperature, number of drinks dispensed, and sensors that determine the amount of concentrate remaining in the beverage dispensing system. The microprocessor can also provide service diagnostics, and the ability to remotely poll the electronic status.

At the end of concentrate conduit 140 and diluent conduit 130, the respective liquids empty into the nozzle assembly 100. A converging nozzle 120 is threaded onto the nozzle assembly 100. Flow is directed through the nozzle 152 and into a container, cup, or pitcher of the user. The nozzle 120 may have internal flow vanes (not shown) to help straighten the flow and minimize splashing.

Nozzle assembly 100 can include a lever 110. The user initiates the flow of beverage liquid concentrate 212 and diluent 30 by pulling on the lever 110. Beverage liquid concentrate 212 and diluent 30 mix at the nozzle 120 and in vessel of the user.

Referring now to FIG. 6, beverage dispensing system 1010 can include a second self-pressurized concentrate source 1200 and a second connector 1301 fluidly connected to a second source conduit 1150. Second source conduit 1150 is in turn fluidly connected to concentrate flow control valve 1160 which regulates the rate of flow of a second beverage liquid concentrate 1212 into a second concentrate conduit 1140 and in, turn, nozzle 120. In one aspect of the invention, the beverage liquid concentrate 212 and the second beverage liquid concentrate 1212 can be mixed together with diluent 30 at nozzle 120 to form a beverage. In an alternate aspect, beverage liquid concentrate 212 and the second beverage liquid concentrate 1212 can be mixed separately with diluent 30 at nozzle 120 to form separate beverages and provide additional beverage options to a user.

As shown in FIG. 7, diluent 30 can be locally stored in beverage dispensing system 2010 in a reservoir 132 contained within housing 20. In this aspect, reservoir 132, diluent conduit 130, concentrate conduit 140, concentrate flow control valve 160, and self-pressurized concentrate source 200 are all positioned within an interior area of housing 20. Utilizing such a reservoir 132 with self-pressurized concentrate source 200 allows for a self-contained beverage dispensing system 2010 that can be placed on a countertop apart from water or electrical power sources. In an alternate aspect, beverage dispensing system 2010 can be a mobile beverage dispensing system suitable for carrying. In a further aspect of the invention, beverage dispensing system 2010 can include a manual pump, an electrical pump, or a pressure source to draw diluent 30 into diluent conduit 131.

Referring now to FIGS. 8-10, beverage dispensing system 3010 can include a connector 1300 adapted to retain and connect additional self-pressurized concentrate sources 200. As shown, connector 1300 can connect up to four self-pressurized concentrate sources 200. However, connector 1300 can be modified to accommodate additional self-pressurized concentrate sources 200 including up to six self-pressurized concentrate sources 200, up to eight self-pressurized concentrate sources 200, and up to ten self-pressurized concentrate sources 200. In an alternate aspect of the invention, the beverage dispensing system can utilize two or more connectors 1300. Connector 1300 includes a housing 1310 and up to four concentrate source chambers 1312. A self-pressurized concentrate source 200 can be placed within a concentrate source chamber 1312, as shown in FIG. 8. Connector 1300 also includes up to four valve activation devices 1320—one for each concentrate source chamber 1312.

Activation stem 1322 is located at the bottom or proximal portion of valve activation device 1320. Activation stem 1322 extends through an orifice in the top surface of housing 1310 to engage the valve of self-pressurized concentrate source 200 (discussed above with respect to FIGS. 2-4). Valve activation device 1320 includes a through bore though which beverage liquid concentrate can flow after engagement with the valve of self-pressurized concentrate source 200. Valve activation device 1320 also includes a handle 1326, a spring seat 1330, a helical spring 1328, and a spring housing 1314. The lateral portions of handle 1326 can be threaded or otherwise fastened onto the longitudinal shaft of valve activation device 1320. Alternatively, the lateral portions of handle 1326 can be integrally formed with the longitudinal shaft of valve activation device 1320. Spring housing 1314 is attached to the top surface of housing 1310 and surrounds spring 1328 and a portion of the longitudinal shaft of valve activation device 1320 below handle 1326. The interaction of spring 1328 with spring seat 1320 and spring housing 1314 pushes activation stem 1322 downward into housing 1310 and concentrate source chamber 1312 to engage the valve of the self-pressurized concentrate source 200.

When a user wishes to connect a self-pressurized concentrate source 200 to beverage system 3010, the user can pull upwards on handle 1326 of valve activation device 1320 to compress spring 1328 against spring housing 1314 and draw activation stem 1322 upwards and out of concentrate source chamber 1312. The user can then insert a self-pressurized concentrate source 200 into concentrate source chamber 1312. Once self-pressurized concentrate source 200 is properly seated within chamber 1312, the user can lower valve activation device 1320 such that activation stem 1322 extends into chamber 1312 to engage the valve of self-pressurized concentrate source 200, thus releasing beverage liquid concentrate into the beverage system 3010. Additional self-pressurized concentrate sources 200 can be utilized with connector 1300. While connector 1300 is shown to connect up to four self-pressurized concentrate sources 200, connector 1300 can be modified to accommodate any number of self-pressurized concentrate sources 200.

As shown in FIG. 10, beverage dispensing system 3010 can include a first self-pressurized concentrate source 200, a second self-pressurized concentrate source 1200, a third self-pressurized concentrate source 2200, and a fourth self-pressurized concentrate source 3200 fluidly connected first source conduit 150, second source conduit 1150, third source conduit 2150, and fourth source conduit 3150, respectively. Source conduits 150, 1150, 2150, and 3150 are in turn fluidly connected to first concentrate flow control valve 160, second concentrate flow control valve 1160, third concentrate flow control valve 2160, and fourth concentrate flow control valve 3160, respectively. Flow control valves 160, 1160, 2160, and 3160 regulate the rate of flow of beverage liquid concentrates 212, 1212, 2212, and 3212 into first concentrate conduit 140, second concentrate conduit 1140, third concentrate conduit 2140, and fourth concentrate conduit 3140, respectively, and in tarn, nozzle 120. In one aspect of the invention, the beverage liquid concentrates 212, 1212, 2212, and 3212 are mixed individually with diluent 30 at nozzle 120 to form a beverage and provide multiple beverage options to a user. In an alternate aspect, two or more of beverage liquid concentrates 212, 1212, 2212, and 3212 can be mixed together with diluent 30 at nozzle 120 to form a beverage.

Concentrate flow control valves 160, 1160, 2160, and 3160 and diluent flow control valve 170 can be a mechanical valve, e.g., a conventional plunger valve that is movable between fully-opened and fully-closed positions. In addition, each of valves 160, 1160, 2160, 3160, and 170 can contain an orifice restriction of a predetermined size to meter the flow of liquid therethrough. That is, based on the relative sizes of the orifice restrictions of the valves, the correct proportion of the diluent or beverage liquid concentrate can be maintained regardless of the incoming pressure. In an alternate aspect of the invention, valves 160, 1160, 2160, 3160, and 170 can be an electronic solenoid-operated valve. In this aspect, operation of valves 160, 1160, 2160, 3160, and 170 can be controlled by an electronic control module that includes a programmable microprocessor.

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventor(s), and thus, are not intended to limit the present invention(s) and the appended claims in any way.

The present invention(s) have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention(s) that others can, by applying knowledge within the skill of the art, readily modify and/or adapt for various applications such specific embodiments, without undue experimentation, without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention(s) should not be limited by any of the above-described exemplary embodiments, but should be defined only in accordance with the following claims and their equivalents.

What is claimed is:

1. A post-mix beverage dispensing system comprising:

a nozzle;

a diluent conduit in fluid communication with the nozzle;

a concentrate conduit in fluid communication with the nozzle;

a flow control valve in fluid communication with the concentrate conduit and a source conduit; and a self-pressurized concentrate source connected to the source conduit by a connector, the pressurized concentrate source including:

a concentrate chamber containing a beverage concentrate, a pressurized outer container surrounding the concentrate chamber and exerting a pressure on the concentrate chamber, and a valve assembly in fluid communication with an interior of the concentrate chamber, such that the connector opens the valve assembly, wherein the beverage concentrate and a diluent mix at the nozzle to dispense a beverage.

2. The post-mix beverage dispensing system of claim 1, further comprising a housing, such that the diluent conduit, concentrate conduit, flow control valve, and pressurized concentrate source are positioned within an interior area of the housing.

3. The post-mix beverage dispensing system of claim 1, wherein the concentrate chamber and the pressurized outer container are transparent, and wherein the concentrate chamber is a bag.

4. The post-mix beverage dispensing system of claim 1, wherein the beverage concentrate has a concentration ratio of greater than or equal to approximately 30:1.

5. The post-mix beverage dispensing system of claim 1, wherein the beverage concentrate has a concentration ratio of greater than or equal to approximately 80:1.

6. The post-mix beverage dispensing system of claim 1, further comprising a diluent reservoir containing the diluent, the diluent reservoir being in fluid communication with the diluent conduit.

7. The post-mix beverage dispensing system of claim 6, further comprising a housing, such that the diluent reservoir, diluent conduit, concentrate conduit, flow control valve, and pressurized concentrate source are positioned within an interior area of the housing.

8. The post-mix beverage dispensing system of claim 1, wherein the connector further comprises:

a sealing collar to surround a portion of the pressurized outer container, a valve activation device to engage the valve assembly; and a transfer shaft in fluid communication with the source conduit.

9. The post-mix beverage dispensing system of claim 1, further comprising:

a second concentrate conduit in fluid communication with the nozzle;

a second flow control valve in fluid communication with the second concentrate conduit and a second source conduit; and a second self-pressurized concentrate source connected to the second source conduit by a second connector, the second pressurized concentrate source including:

a second concentrate chamber containing a second beverage concentrate, a second pressurized outer container surrounding the second concentrate chamber and exerting a pressure on the second concentrate chamber, and a second valve assembly in fluid communication with an interior of the second concentrate chamber, wherein the second beverage concentrate and the diluent mix at the nozzle to dispense a beverage.

10. A method for dispensing a beverage from a post-mix beverage dispensing system comprising:

connecting a self-pressurized concentrate source to a connector, the connector being in fluid communication with a dispensing nozzle, the pressurized concentrate source including:

a concentrate chamber containing a beverage concentrate, a pressurized outer container surrounding the concentrate chamber and exerting a pressure on the concentrate chamber, and a valve assembly in fluid communication with an interior of the concentrate chamber, such that the connector opens the valve assembly to provide the beverage concentrate to a source conduit; and mixing the beverage concentrate and a diluent at the dispensing nozzle to dispense a beverage.

11. The method of claim 10, wherein the post-mix beverage dispensing system includes a housing, such that a diluent conduit, a concentrate conduit, a flow control valve, and the self-pressurized concentrate source are positioned within an interior area of the housing.

12. The method of claim 10, wherein the concentrate chamber and the pressurized outer container are transparent.

13. The method of claim 10, wherein the beverage concentrate has a concentration ratio of greater than or equal to approximately 30:1.

14. The method of claim 10, wherein the beverage concentrate has a concentration ratio of greater than or equal to approximately 80:1.

15. The method of claim 10, wherein the post-mix beverage dispensing system includes a diluent reservoir containing the diluent such that the diluent reservoir is in fluid communication with a diluent conduit.

16. The method of claim 15, wherein the post-mix beverage dispensing system includes a housing, such that the diluent reservoir, the diluent conduit, a concentrate conduit, a flow control valve, and pressurized concentrate source are positioned within an interior area of the housing.

17. The method of claim 10, wherein the connector further comprises:

a sealing collar to surround a portion of the pressurized outer container;

a valve activation device to engage the valve assembly; and a transfer shaft in fluid communication with the source conduit.

18. A method of retrofitting a post-mix beverage dispensing system with a self-pressurized concentrate source, the method comprising:

disconnecting a non-pressurized concentrate source from a source conduit;

disconnecting a pressurized air tank from the post-mix beverage dispensing system;

connecting a connector to the source conduit, the source conduit being in fluid communication with a dispensing nozzle; and connecting a self-pressurized concentrate source to the connector, the self-pressurized concentrate source including:

a concentrate chamber containing a beverage concentrate, a pressurized outer container surrounding the concentrate chamber and exerting a pressure on the concentrate chamber, and a valve assembly in fluid communication with an interior of the concentrate chamber, such that the connector opens the valve assembly to provide the beverage concentrate to the source conduit, wherein the post-mix beverage dispensing system mixes the beverage concentrate and a diluent at the dispensing nozzle to dispense a beverage.

* * * * *